United States Patent [19]

Simon et al.

[11] Patent Number: 4,870,902

[45] Date of Patent: Oct. 3, 1989

[54] INITIATING SYSTEM

[75] Inventors: James R. Simon, Lachute; Donald C. True, Brownsburg; Jacques Lafond, Lachute, all of Canada

[73] Assignee: CXA Ltd./ CXA LTEE, Montreal, Canada

[21] Appl. No.: 175,035

[22] Filed: Mar. 29, 1988

[51] Int. Cl.[4] ..... F42C 11/00

[52] U.S. Cl. ..... 102/201; 102/218

[58] Field of Search ..... 102/201, 206, 218, 220

[56] References Cited

U.S. PATENT DOCUMENTS

| | | | |
|---|---|---|---|
| 3,351,016 | 11/1967 | Simpson | 102/201 |
| 4,149,466 | 4/1979 | Fojt et al. | 102/201 |
| 4,586,437 | 5/1986 | Miki et al. | 102/220 |
| 4,700,629 | 10/1987 | Bensen et al. | 102/201 |

*Primary Examiner*—Charles T. Jordan

*Attorney, Agent, or Firm*—Barlow: C. Brian

[57] ABSTRACT

A system is provided for initiating a blasting cap wherein pulsating light energy is converted to electrical energy. An optical coupler couples the source of energy to a remote firing arrangement to transfer the generated pulsating light energy to the firing arrangement. An electrical connection connects the firing arrangement to an ignition resistor in a detonator. Thus, the generated light energy is converted to electrical energy and is transferred to the ignition resistor, the transferred electrical energy being the firing energy for the ignition resistor.

6 Claims, 3 Drawing Sheets

DISPOSABLE DEVICE
3
17
18
19
2
4
SIGNAL
7
POWER OUTPUT
6
OSCILLATOR
101
5
POWER SUPPLY
FIRING CONTROL UNIT
1
13
FIRING CIRCUIT
12
11
SWITCHING POWER SUPPLY
PHOTOVOLTAIC CELL
10
LIGHT BULB
9
LIGHT DETECTOR
16
LIGHT SOURCE
15
8
PHOTO-COUPLED FIRING CIRCUIT

INITIATING SYSTEM

BACKGROUND OF THE INVENTION

1. Field of the Invention

The present invention relates to an initiating system for providing firing energy to a detonator used in blasting with explosives. More specifically, the invention relates to such a system wherein light energy is converted to electrical energy for the firing of a detonator.

2. Description of Prior Art

The mining and construction industries are very aware of the hazards involved in the use of electric detonators for blasting in conductive underground ore bodies where the detonators are susceptible to accidental initiation by stray currents created by high voltage electrical equipment. It is also known that electric detonators are prone to initiation by electrostatic discharges generated by explosive loading equipment or by lighting strikes in conductive ore deposits which produce high voltage transients at the working face.

In surface blasting applications at construction sites, for example, hazards are likely to arise when blasting is conducted with electric detonators in relatively close proximity to radio or radar transmitting antennas. The American National Standards Insitute has established safe distance of blasting operations from fixed radio frequency transmitting antennas, but there is little control over mobile transmitters which frequently transmit with power levels well in excess of the legal limit of 5 watts. Although mobile transmitters per se are banned from blasting sites, there is little control over vehicles transmitting from nearby public roads.

The hazards arising from static discharges, electrical storms, ground currents, electric power generators, transmission lines, rf antennas or electromagnetic fields generated by other means are all additive. At some blasting locations, complex situations may arise which make it necessary to call in expert technical assistance to determine whether a hazard exists. This results in additional expense and delays for the mine operator or blasting contractor.

Over the past several years, many mines and quarries have converted to the use of non-electric blasting systems in order to avoid the hazards of electric initiated detonators previously described. Typically, a non-electric blasting system employs a shock wave conductor as the initiator means for a detonator. A shock wave conductor or shock tube comprises a hollow, non-conductive plastic tube with a thin layer of explosive dust deposited on its inner surface. When initiated at one end by detonating cord or similar shock producing device, a shock front propagates along and within the length of the tube to initiate a detonator attached at the opposite end.

In a typical shock tube blast, the boreholes to be loaded with explosives are each primed with a delay detonator having a specified delay time and to which a length of shock tube is attached. The ends of the tubing extending from each borehole are connected to a common detonating cord trunkline by means of connectors. A blasting round hooked up in this manner is completely non-electric and non-conductive and is therefore safe from any inadvertent electrical initiation.

To initiate a blast which uses shock tube and non-electric detonators and a detonating cord trunkline, it has been common practice to set off the detonating cord by means of an attached electric detonator. As a safe practice, some larger mines are evacuated, and the blasting of multiple faces located throughout the mine is controlled electrically by a central blasting station on surface. The introduction of an electric detonator to initiate the trunkline however, defeats the safety advantages gained through the use of the shock tube system. For this reason, many mining managers have elected not to use fully electric central blasting systems and have been searching for alternate methods to improve the safety of their operation.

In some operations the shock tube and associated trunkline is initiated by tying a safety fuse assembly to the detonating cord. The safety fuse assembly comprises a factory-assembled length of safety fuse with a detonator crimped to one end and an igniter cord connector as a means of lighting the fuse at the opposite end. To this fuse assembly, a short length of igniter cord is attached which is, in turn, connected to an HFE electric starter. The HFE electric starter requires an ignition current of 3 amps and is ten time less sensitive than conventional electric detonators. Although this make-shift system improves the safety somewhat, it tends to be cumbersome, is sometimes prone to failure by virtue of the various manual connections required and can still be readily initiated by simple electrical means. The use of safety fuse is also declining for safety reasons. As a result of a number of recent mining fatalities involving the misuse of safety fuse, several jurisdictions are considering legislation banning its use.

Other blasting operations make use of exploding bridge wire (EBW) detonators in extremely hazardous locations. These specialized detonators are safe by virtue of the fact that they do not contain a sensitive primary explosive and require in excess of 2000 volts from a specially designed power supply to achieve initiation. Apart from being expensive, they are limited to relatively short lead-in wires and are not suitable for multipoint initiation from a centralized blasting location.

Most recently some blasting operations are employing a transformer coupled system in conjunction with centralized blasting. Transformer coupled systems are electric detonators with sliding, insulated toroidal transformers attached to the end of the detonator lead wires. This provides protection from stray currents and most electrical interference. They are however limited to the use of relatively short firing circuit wires.

There is, therefore, a continuing need for an initiating system for blasting which retains the reliability of conventional electric systems but which reduces or substantially eliminates the hazards associated therewith.

SUMMARY OF THE INVENTION

It is an object of the invention to provide an initiating system which overcomes substantially all of the disadvantages of the prior art.

It is a more specific object of the invention to provide an initiating system wherein light source energy is converted to electrical energy for the firing of a detonator.

In accordance with the present invention a blasting cap initiating system is provided which comprises means for generating a coded light signal, means for recognizing the coded signal, means for converting the coded light signal to electrical energy, means to store the said electrical energy and means to transfer the said stored energy to a detonator. Thus, a generated, coded light signal is converted to electrical energy, stored until a sufficient firing energy lever is reached and then transferred to a detonator, the transferred electrical energy comprising energy required to initiate the detonator.

A particular feature of the system of the invention is its ability to recognize only a specific or coded light signal for utilization as the primary energy source for the ultimate firing of the detonator. This is accomplished by providing a pulsed on/off electrical signal simultaneously to a first light source, for example, a light bulb, and a second light source, for example, a light emitting diode (LED) causing both the lightbulb and the LED to be illuminated. The light from the lightbulb is converted to electrical energy by a photovoltaic cell and the light signal from the LED is transmitted to a photodetector. When the LED is ON, the photodetector is also ON. This provides a trigger mechanism which allows energy from the photovoltaic cell to be charged into a storage condenser. Unless both the lightbulb and LED are tuned to the frequency of the ON/OFF pulsed electrical signal, charging of the condenser is prevented and hence no electrical energy is available to initiate the detonator. Thus, the energy for initiation of the detonator is initially supplied by a light source such as a filament bulb, laser, laser diode, LED diode or via an optical fibre. This light energy is converted into electrical energy by means of a photovoltaic cell or photo diode. The low voltage from the photovoltaic cell is amplified and charged in an electronic circuit and delivered to a capacitor for storage. The amplifying and charging circuit is adapted to function only if a suitably encoded enabling light signal is received.

DESCRIPTION OF PREFERRED EMBODIMENTS

Figure 1:
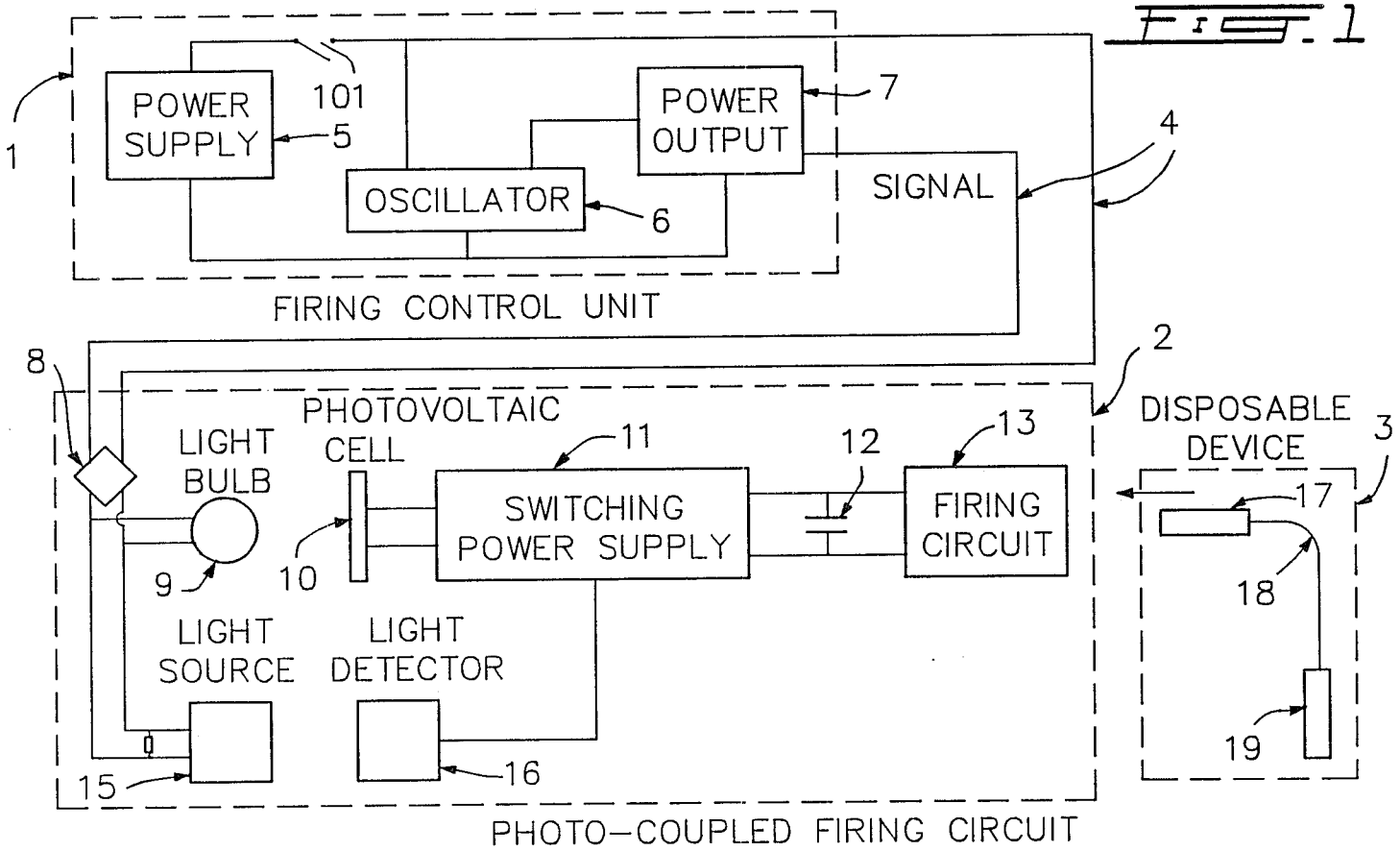
FIG. 1 is a block diagram of the initiating system of the invention.

Referring to FIG. 1 where the initiating system is generally depicted, three separate components designated 1, 2 and 3 are shown. Component 1, labelled the "Firing Control Unit", comprises a power supply 5 with associated oscillator 6 and power output 7. A pulsed electrical signal is delivered from the control unit 1 through switch 101 via conductors 4 and rectifier bridge 8 to component 2 which is the "Photo-Coupled Firing Circuit". Conductors 4 provide power for a first light source 9 and a second light source 15. The first light source 9 can comprise a lightbulb for generating light energy. The second light source 15 may comprise, for example, a light emitting diode (LED) for optical coupling and control purposes as will be discussed below.

Component 2 comprises a firing arrangement including a means 11 for processing the electrical energy, a means 12 for storing the electrical energy, and a firing circuit 13. Attached to the input of the means for processing electrical energy is a means for receiving light energy and converting it to electrical energy, comprising, for example, a photovoltaic cell 10 and a light detector 16 which may comprise a photodiode. Photovoltaic cell 10 is positioned to receive pulsating light energy from the lightbulb 9 and the light detector 16 is positioned to receive a pulsating light signal from the light source 15.

Component 3, labelled "Disposable Device" comprises the initiation unit itself and consists of a squib 17, a shock wave conductor lead-in line 18 and a detonator 19. The squib 17, which provides firing energy for the detonator 19, is adapted for plug-in connection with firing circuit 13 of component 2.

Figure 2:
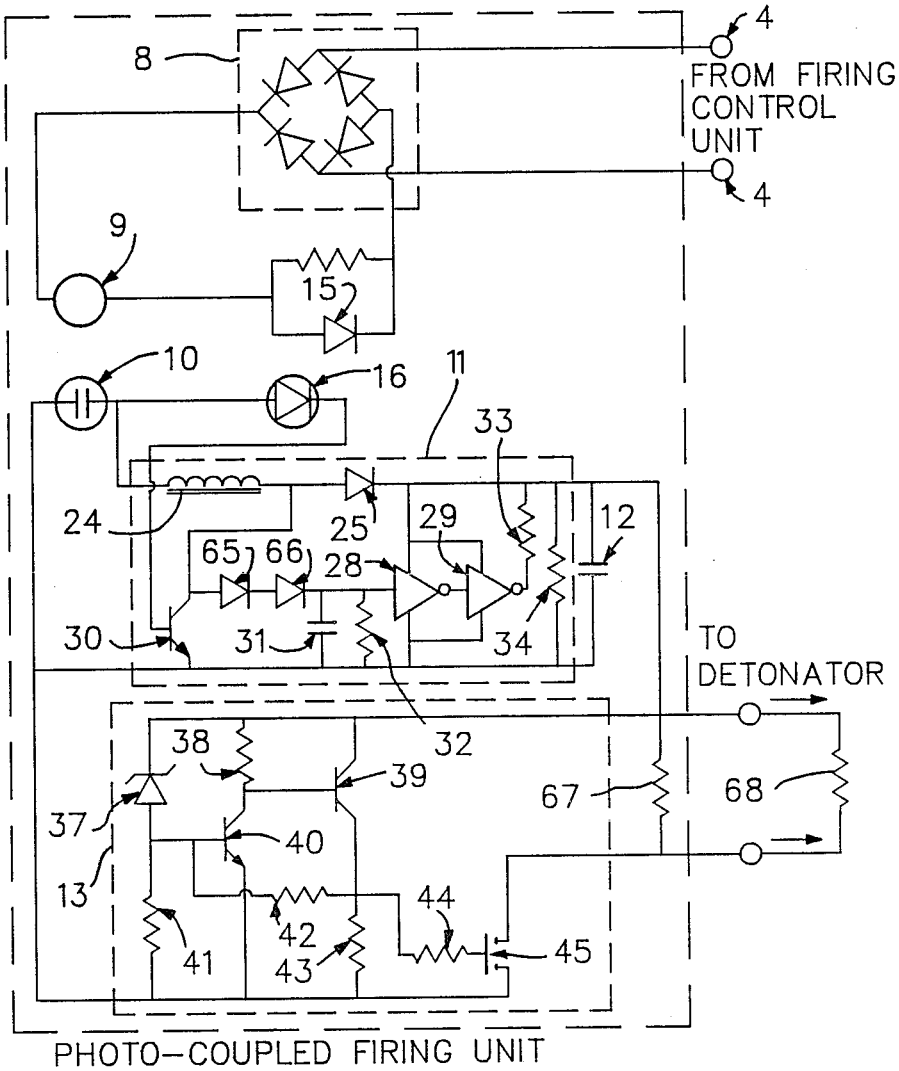
FIG. 2 is a circuit schematic of the photo-coupled firing unit of FIG. 1.

Referring to FIG. 2, pulsed electrical signal carried by conductors 4 is delivered to light bulb 9 and LED 15. The light energy generated by lightbulb 9 is received by the means for receiving the light energy and converting it to electrical energy. In the illustrated embodiment, this comprises the solar cell 10. The light energy from LED 15 is received by photodiode 16. Thus, solar cell 10 is disposed to receive light from lamp 9, and photodiode 16 is disposed to receive light from LED 15.

The switching power supply generally designed 11 for processing the converted electrical energy comprises an inductor 24 and transistor 30 in conjunction with photovoltaic cell 10 and light detector 16. Means 11 also includes a security circuit which rejects low frequencies and discharges capacitor 12 in the event of interruption or absence of the correct coded signal. The security circuit includes diodes 65 and 66, capacitor 31, resistors 32, 33 and 34 and inverters 28 and 29. The means for storing the process electrical energy comprises a capacitor 12. A diode 25 is shown between inductor 24 and capacitor 12.

The firing or triggering circuit generally designated 13 comprises zener diode 37 connected to a high current solid state switch such as a power mos field effect transistor 45. Connected between the zener diode 37 and the field effect transistor 45 are transistors 40 and 39. Resistors are shown at 38, 41, 42, 43 and 44.

In operation, when the positive going portion of the pulse train is applied to the lightbulb 9 and the LED 15, both the lightbulb and the LED will be illuminated. Light energy, generated by the lightbulb 9, will be transmitted to the solar cell 10, and the light signal, generated by the LED 15, will be transmitted to the photodetector 16. The light energy, received by the solar cell 10, is converted to electrical energy by solar cell 10. When LED 15 is ON, and photodetector 16 is also ON, transistor 30 is turned ON. Accordingly there is a low impedance discharge path for the solar cell 10 through the inductor, so that the electrical energy is stored in the inductor when LED 15 is turned ON.

When the zero level or negative going portion of the pulse train is applied to the lightbulb 9 and LED 15, both of these light sources are turned OFF. Accordingly, no further light energy is transmitted to the solar cell 10, and photodetector 16 is turned OFF. With photodetector 16 turned OFF, transistor 30 is turned OFF. The energy stored in the inductor is released as a voltage spike in the order of 10 to 15 volts which charges the capacitor 12 through the diode 25. A portion of the charging energy will also be applied to the capacitor 31 through diodes 65 and 66.

Although a voltage spike of 10 to 15 volts is produced, the capacitor will not charge up to that voltage level. Instead, several cycles will be required for the capacitor 12 to charge up to the level of 9 volts. In one specific example, approximately seven seconds were needed to charge a 260 microfarad capacitor at a frequency of 3 KHz and a duty cycle of 90% on time and 10% off time.

When capacitor 12 is charged to a level of 9 volts, zener diode 37 is turned ON so that current can flow through the resistor 41. The resulting voltage drop across resistor 41 will provide a signal to the transistor 40 which in conjunction with transistor 39, provides an amplified signal to turn on the high current solid state switch 45. The current from capacitor 12 is then allowed to flow through the ignition resistor 68. A small portion of this current will also flow through shunt resistor 67.

It can be seen that the zener diode 37 senses when the capacitor 12 has reached the firing voltage, whereupon it provides a path for current from the capacitor 12 to ignite the squib 17 (FIG. 1). Detonator 19 is ignited by energy carried from electrically-ignited squib 17 by means of a shock wave conductor 18.

The system as above described operates only within a given range of frequencies and duty cycles. If the frequency is too low, then capacitor 31 will not charge up. Accordingly, inverter 29 will provide a low impedance discharge path for capacitor 12. The upper frequency of operation is limited by both the frequency response of the photodetector 16 and the time constant of the inductor circuit.

The pulsating light source must have the correct duty cycle at the correct frequency in order to activate the charging circuit for capacitor 12. The duty cycle is defined as the percentage of time in each cycle during which the light remains ON. A minimum on time and a minimum off time is required to store the energy in the inductor and release it.

Thus, the system is "coded". Specifically, unless the right type of signal is provided to the lightbulb 9 and the LED 15, firing energy will not be provided to the ignition resistor.

The requirement that several cycles are needed to drive the voltage on capacitor 12 up to the firing voltage is an advantage in safety in that a waiting period is provided during which time the circuit can be deactivated by removal of the "coded" signal.

Transistors 40 and 39 are provided for speeding up the firing of the field effect transistor 45.

The system will not be set off by stray fields or by randomly transmitted radio waves. The energy from the light generator is coupled optically to the firing circuit so that it will not be affected by such stray fields or randomly transmitted radio waves.

Figure 3:
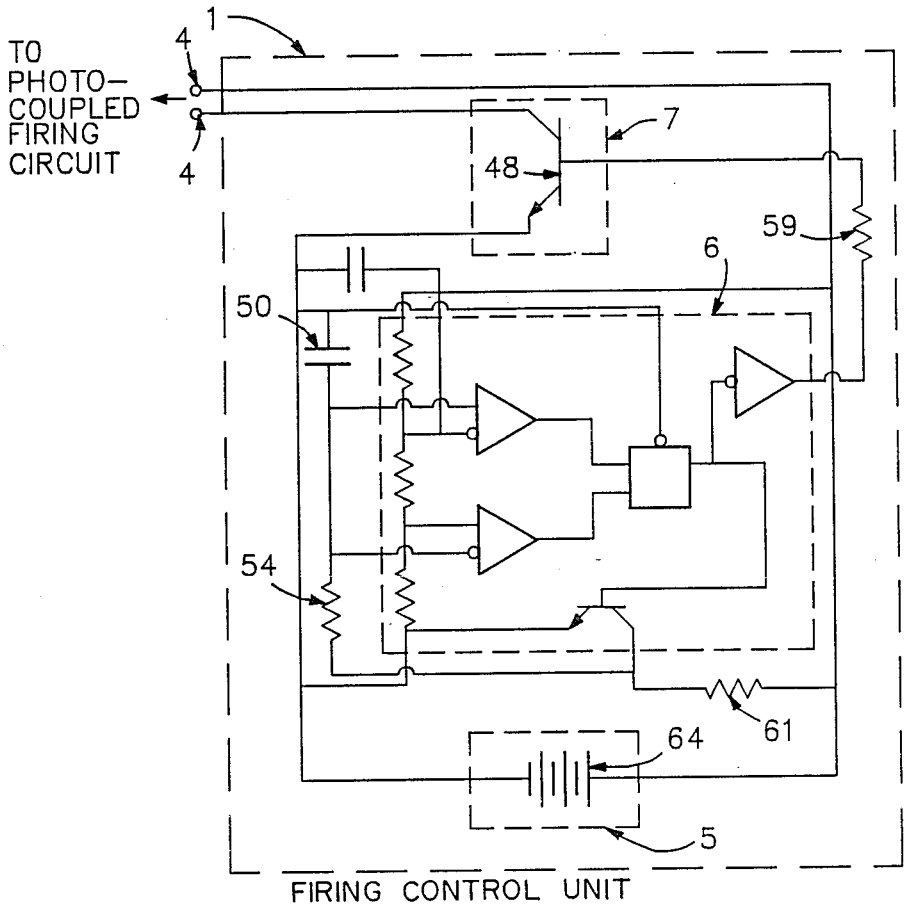
FIG. 3 is a circuit schematic of the firing control unit of FIG. 1.

Referring to FIG. 3, the firing control unit comprises a means for generating a pulse train. In the embodiment shown, the means for generating a pulse train comprises an astable multivibrator 6 whose output is fed to the base of transistor 48. The output of the transistor 48 is fed to rectifier bridge 8 (FIG. 2) whose output drives both the lightbulb 9 and the light source 15. The frequency and duty cycle of the pulse generator are determined by the selected values of capacitor 50, resistor 54 and resistor 61.

Although not specifically depicted, a further useful feature of the invention is the addition of current regulation to the photo-coupled firing unit identified as 2 in FIG. 1. This feature improves power distribution in large centralized blasting operations by permitting initiation of explosive charges at many blasting locations which are separated from each other by long lengths of initiating wire. The device typically draws 100 milliamps and can operate on standard wire sizes up to distances of five miles.

Although not specifically depicted, a still further useful feature of the invention is the addition of a "firing signal" to the said coded signal. This feature provides the advantage of accurate timing of multiple blast holes and can be used to initiate a large number of detonators simultaneously or provide synchronization for electronic timing counters which counters can introduce discrete time delays between blast holes. The means for coding the optical signal need not be limited to electrical means but may include, for example, the use of different wave lengths which can be decoded through difraction or other electronic means.

It is envisioned that miniaturization techniques may allow the Photo-Coupled Firing Circuit and the Disposable Device to be combined into a single integrated device. Such a device might be enclosed for example, within the confines of a specially adapted detonator.

Although a particular embodiment has been described, this was for the purpose of illustrating, but not limiting, the invention. The two light sources and two light receivers described in the preferred embodiment can be replaced with one light source and one receiver if, for example, the energy requirements of the system are low or if higher efficiency light emitters and receivers are employed.

Various modifications or component substitutions such as LASER diodes or commercially available optoisolators, which will come readily to the mind of one skilled in the art, are within the scope of the invention as defined in the appended claims.

What is claimed is:

1. An initiating system for providing firing energy and an activating signal to a detonator, comprising:

(a) at least one means for generating a pulsating, coded light energy;

(b) at least one means for receiving said pulsating, coded light energy and converting said light energy to low level electrical energy insufficient to activate a detonator;

(c) means isolated from said light energy generating means for identifying said coded signal and converting said low level electrical energy to a high level of electrical energy sufficient to activate a detonator, comprising, in circuit arrangement, an inductor connected in series with said means for converting light energy to electrical energy;

(d) means to store the said high level electrical energy comprising a capacitor connected in series with said inductor; and (e) means to transfer the said stored high level electrical energy to a resistor element of a detonator;

whereby said generated, pulsating, coded light energy is converted to usable electrical energy in response to said light energy identifying means; said usable electrical energy is transferred to said detonator and said transferred electrical energy comprises said firing energy, and whereby when said light energy generating means is ON, energy is stored in said inductor, and, when said light energy generating means is OFF, said energy stored in said inductor is transferred to said capacitor.

2. A system as defined in claim 1 further including means for sensing the level of said stored energy in the said capacitor which means comprises a zener diode connected across said capacitor whereby, when the voltage across said capacitor reaches a predetermined level, said zener diode is turned ON.

3. A system as defined in claim 2 further including means for transferring said energy stored in said capacitor to said detonator resistor element, said means for transferring comprising a high current solid state switch connected in circuit to be triggered by said zener diode when said zener diode is turned ON.

4. A system as defined in claim 3 wherein said high current solid state switch is a power mos field effect transistor.

5. A system as defined in claim 1 further including a security circuit adapted to reject low frequencies and to discharge the said storage capacitor in the event of interrupted or improperly coded light energy signals, the said security circuit comprising a second capacitor adapted to receive a charge from said inductor and to discharge said charge through a resistor and an inverter.

6. A system as claimed in claim 1 further including means to regulate the current delivered to the said light generating means.

* * * * *